US008757437B2

(12) United States Patent
Schneider

(10) Patent No.: US 8,757,437 B2
(45) Date of Patent: Jun. 24, 2014

(54) GAS LINE LEAKAGE MONITOR FOR BEVERAGE DISPENSING SYSTEM PREVENTING UNINTENDED ENVIRONMENTAL DISCHARGE

(75) Inventor: Daniel E Schneider, Worland, WY (US)

(73) Assignee: Bevtech, Inc., Fort Collins, CO (US)

( * ) Notice: Subject to any disclaimer, the term of this patent is extended or adjusted under 35 U.S.C. 154(b) by 84 days.

(21) Appl. No.: 13/449,796

(22) Filed: Apr. 18, 2012

(65) Prior Publication Data

US 2012/0291871 A1 Nov. 22, 2012

Related U.S. Application Data

(63) Continuation of application No. PCT/US2010/053275, filed on Oct. 19, 2010.

(60) Provisional application No. 61/252,974, filed on Oct. 19, 2009.

(51) Int. Cl.
*B67D 1/00* (2006.01)
*B67D 1/12* (2006.01)
*B67D 7/02* (2010.01)

(52) U.S. Cl.
CPC ..... *B67D 1/12* (2013.01); *B67D 1/1252* (2013.01); *B67D 7/0238* (2013.01)
USPC ..... 222/59; 222/640; 222/129.1

(58) Field of Classification Search
CPC ..... B67D 1/12; B67D 1/1252; B67D 1/025; B67D 7/0238
USPC ..... 222/59, 2, 3, 14, 20–22, 639, 640, 129, 222/129.1, 129.2, 129.4, 399
See application file for complete search history.

(56) References Cited

U.S. PATENT DOCUMENTS 4,100,537 A 7/1978 Carlson
4,269,061 A * 5/1981 Hatsuno et al. ..... 73/40

(Continued)

FOREIGN PATENT DOCUMENTS

JP 2007-243598 9/1995
JP 2002-214004 7/2002
KR 10-0836072 6/2008

OTHER PUBLICATIONS

Brasch Manufacturing Company, Inc., Gas Testing Kit for Model GSE Carbon Monoxide Gas Detectors Serial Nos. S-6000 and Above Model GSE Carbon Monoxide Gas Transmitters Serial Nos. P-4468 and Above, IOM #i-691, Jul. 2004.

(Continued)

*Primary Examiner* — Lien Ngo
(74) *Attorney, Agent, or Firm* — Blynn L. Shideler; Krisanne Shidelar; BLK Law Group

(57) ABSTRACT

A gas line leakage monitor for beverage dispensing system is configured to prevent unintended environmental discharge of a beverage dispensing gas such as CO2. The monitor includes a gas inlet coupled to the source of gas and a gas outlet coupled to the dispensing portions of the system. The monitor includes a flow sensor detecting when gas is flowing through the monitor. The monitor includes a timer coupled to the flow sensor and tracking the amount of time that the flow sensor detects at least each episode of un-interrupted flow of gas through the monitor. The monitor includes a shut-off valve coupled to the timer for stopping the flow of gas through the monitor and to the system's dispensing portions when the timer indicates an episode of un-interrupted gas flow through the monitor meets a pre-set threshold. The monitor includes a manual reset for opening the shut-off valve.

19 Claims, 2 Drawing Sheets

(56) References Cited

U.S. PATENT DOCUMENTS

| | | | | |
|---|---|---|---|---|
| 4,270,466 | A | 6/1981 | Ansen et al. | |
| 4,881,948 | A * | 11/1989 | Nakane et al. | 48/192 |
| 4,916,437 | A * | 4/1990 | Gazzaz | 340/632 |
| 4,936,343 | A | 6/1990 | Pruitt et al. | |
| 5,113,905 | A | 5/1992 | Pruitt et al. | |
| 5,261,268 | A * | 11/1993 | Namba | 73/40.5 R |
| 5,492,250 | A | 2/1996 | Sardynski | |
| 5,554,976 | A * | 9/1996 | Miyauchi et al. | 340/626 |
| 5,839,483 | A | 11/1998 | Rejret et al. | |
| 6,449,532 | B1 | 9/2002 | Nicol | |
| 6,588,632 | B1 | 7/2003 | Nicol | |
| 6,601,618 | B2 | 8/2003 | Tsukano et al. | |
| 6,725,878 | B1 * | 4/2004 | Nawa et al. | 137/487.5 |
| 7,258,127 | B1 | 8/2007 | Schneider | |
| 7,832,592 | B2 * | 11/2010 | Bodemann | 222/53 |
| 7,918,367 | B2 * | 4/2011 | O'Donnell | 222/63 |
| 8,011,539 | B1 * | 9/2011 | O'Donnell et al. | 222/394 |
| 8,176,936 | B2 * | 5/2012 | Naganuma et al. | 137/557 |
| 8,387,826 | B2 * | 3/2013 | Tsubouchi et al. | 222/23 |
| 2009/0065068 | A1 * | 3/2009 | McGill | 137/315.06 |
| 2009/0151652 | A1 | 6/2009 | Tian et al. | |

OTHER PUBLICATIONS

Brasch, GSE-TK-CO Brasch GSE Carbon Monoxide Detector / Transmitter Test Kit., http://www.braschmfg.com/Download/Detectors/GSE-TK-CO%20Brochure.pdf.

PEM-Tech, Gas Detector—Gas Sensors | Pem-Tech, http://www.pem-tech.com.

Thermo Scientific, Air Quality Instruments and Systems, http://www.thermoscientific.com/ecomm/servlet/productscatalog?storeId=11152&categoryId=80424&ca=air.

Vaisala, humidity / dew point / moisture in oil / carbon dioxide / pressure / weather, Vaisala_CEN-Instrument-Catalog-2012-B210974EN-C-web, www.vaisala.com.

* cited by examiner

GAS LINE LEAKAGE MONITOR FOR BEVERAGE DISPENSING SYSTEM PREVENTING UNINTENDED ENVIRONMENTAL DISCHARGE

RELATED APPLICATIONS

This application is a continuation of patent application serial number PCT/US10/53275, Filed Oct. 19, 2010, which published as WO 2011/050005 on Apr. 28, 2011, and is incorporated herein by reference and entitled: "GAS LINE LEAKAGE MONITOR FOR BEVERAGE DISPENSING SYSTEM PREVENTING UNINTENDED ENVIRONMENTAL DISCHARGE".

Patent application serial number PCT/US10/53275 claims the benefit of provisional patent application Ser. No. 61/252,974 filed Oct. 19, 2009 entitled "Gas Line Leakage Monitor for Beverage Dispensing System Preventing Unintended Environmental Discharge".

BACKGROUND OF THE INVENTION

1. Field of the Invention

The present invention relates to a gas line leakage and emergency shut-off for a beverage dispensing system preventing unintended environmental discharge of anthropogenic charging gas.

2. Background Information

Carbonated Beverage Industry

This invention generally relates to devices used in the carbonated beverage dispensing industry. This technology may have applications in additional industries using compressed gases having intermittent uses, such as fire protection systems, welding, medical and other industries. The following discussion will relate primarily to the beverage dispensing industry generally in the bar/restaurant fields.

The beverage dispensing industry uses carbon dioxide ($CO_2$ or commonly also CO2) in on-site delivery systems to carbonate and to move beverages from a storage tank to a dispensing area. For beverages such as beer, the beer can be contained in large kegs in a remote location, e.g., the basement or storage room, and the taps (also called dispensing heads) at the bar can dispense the beer. This method eliminates the storage of beer kegs in the bar area and allows the beer keg delivery and removal to occur in an area other than that in which patrons may be sitting. This type of system, herein generically referenced as a CO2 system, has existed for many years.

In order to get the beverages from the storage area to the serving area, conventional CO2 systems have most commonly used carbon dioxide, although other gases have been used. For the purposes of this application all such systems are CO2 systems unless otherwise noted. The carbon dioxide is generally delivered as a liquid in large heavy DOT cylinders and hooked to the dispensing system. When the tanks are hooked to the CO2 system, a certain volume, generally about one third of the tank, in a one tank system or one third of the tank volume in a multi-tank system is not filled with liquid. This allows the carbon dioxide to boil to a gaseous state. It is this gaseous state that is then used to carbonate and to move the desired beverage from the storage room or basement to the delivery area and provide much of the carbonation to the beverages.

In one common CO2 delivery system, the carbon dioxide tanks must be changed or when the current tanks run out. This can be inconvenient and time consuming. This problem can be somewhat lessened by using multiple liquid tanks, but this uses more space and can be more expensive to monitor and refill.

Some CO2 systems exist where the physical changing of the tanks has been eliminated, wherein the system provides a storage containing space (often several canisters) that must be periodically charged U.S. Pat. No. 4,683,921, incorporated herein by reference, discloses a carbon dioxide fill manifold and method for using which is designed to provide an end-user with an uninterrupted supply of carbon dioxide gas, while at the same time eliminating the necessity of transporting individual, conventional pressurized bottles to be refilled. U.S. Pat. Nos. 5,113,905 and 4,936,343, both of which are incorporated herein by reference, disclose a carbon dioxide fill manifold and method for using which is designed to provide an end-user with an uninterrupted supply of carbon dioxide gas, while at the same time eliminating the necessity of transporting individual, conventional pressurized bottles to be refilled. U.S. Pat. No. 6,601,618, incorporated herein by reference, discloses a CO2 system filling apparatus. U.S. Pat. No. 7,258,127 provides a valve, system and method for the delivery of gases or liquids where the delivery persons can fill the CO2 system without having to enter the building and the system can continue to deliver gas to the user. U.S. Pat. No. 7,258,127 is incorporated herein by reference in its entirety. These patents also provide an excellent review of CO2 delivery systems for on site tank type CO2 systems.

Additionally there have been a number of CO2 systems that have attempted to automate the beverage dispensing aspect of the CO2 system to provide a monitoring or to provide that with the single pressing of a button the correct amount of beverage is dispensed. For example see U.S. Pat. No. 5,839,483, which is incorporated herein by reference, relates to manually operated beverage taps used to dispense beer and carbonated beverages; and more particularly to mechanisms for sensing when the tap is being operated by a beverage server and monitoring the amount of beverage that has been dispensed. Programming of dispenser buttons for CO2 systems is also known in the art, as evidenced by U.S. Pat. No. 5,492,250 which is incorporated herein by reference and discloses a CO2 system with a beverage dispenser having control buttons in which a user programs the buttons in a learning mode by filling a container to a specific level; whereby a button is then programmed to dispense that level of fluid. U.S. Pat. No. 5,545,406 which is incorporated herein by reference and discloses dispensing head control of a CO2 system. U.S. Pat. Nos. 6,449,532 and 6,588,632 also disclose a CO2 system with programmable dispensing buttons on the dispensing head using timing circuits to control the delivery pump.

CO2 System Leaks

One of the problems with existing CO2 systems, such as those described above, relates to unintended discharge of the charging gas, namely CO2, to the environment through a leak or system malfunction. An improper seal or connection anywhere in the CO2 system can cause the charging gas to be unintentionally discharged from the system. Similarly a leak anywhere in the system, such as a cracked hose or damaged line can cause the charging gas to be unintentionally discharged from the system. In the environment that these systems are typically used it is not uncommon for components to be damaged. A component malfunction, i.e. the system pump, can cause the cause the charging gas to be unintentionally discharged from the system. It is not uncommon for a well used system to experience numerous unintended system discharges several times in a single year, many requiring servicing and/or recharging of the system. When these leaks go un-noticed or start after normal hours of operating of the establishment, the entire charging system gas can be drained off, leaving the system inoperable until repaired.

There are several major concerns with the unintended discharge of the gas from the CO2 system.

Direct Health Impacts of CO2 System Leaks

The most concerning issue associated with the unintended discharge of the gas from the CO2 system is the build up of CO2 levels in a confined area, such as a basement room or the like. This increase in CO2 concentrations can make the air un-breathable and obviously quite dangerous to restaurant workers, system technicians or others entering a confined area to work on the system.

In order to address these problems, there are Carbon Dioxide sensors that detect undesirably high level of CO2 levels in a space and alert the user. See the Brasch Carbon Dioxide Detector™ for maintaining indoor air quality. See also the industrial instruments from Vaisala (www.vaisala.com), gas detection systems of Pemtech (www.pem-tech.com), air quality instruments from Thermo Scientific (www.thermo-.com), and numerous others. These air quality detectors are helpful in alerting a user if there is an air quality problem, but do little to avert the problem in the first place. Further, these detectors will not go off even if there is a CO2 system leak, unless the CO2 concentration is above the pre-set threshold, whereby in large areas and/or well ventilated areas a CO2 system leak (even one that drains the system) does not set off the detector.

Environments Impacts of CO2 System Leaks

The second issue associated with the unintended discharge of the gas from the CO2 system is the, real or perceived, environmental impact of discharging anthropogenic Carbon Dioxide into the atmosphere. Under the context of "global warming" or man-made "climate change" there has been considerable interest in reducing anthropogenic (man-made) CO2 emissions. Although some have noted that CO2 levels in the earth's atmosphere have fluctuated wildly for millennia; at one point billions of years ago, it was the dominant gas in the atmosphere. Further others have pointed to non-man made factors, such as solar cycles, natural greenhouse gas sources, etc, being the dominant driving force(s) for climate change. Regardless, according to the Intergovernmental Panel on Climate Change (IPCC), the more greenhouse gases there are in the atmosphere, especially carbon dioxide, the more heat is trapped, and leading to rising temperatures.

In April of 2009 the Environmental Protection Agency (EPA) of the United Stated decided to classify rising carbon-dioxide emissions as a hazard to human health. The EPA endorsed the IPCC research and specifically said that "natural variations" in climate, such as solar activity, couldn't explain rising temperatures. The EPA, in 2009, lumped carbon dioxide (CO2) with five other gases—methane, nitrous oxide, hydrofluorocarbons, perfluorocarbons and sulfur hexafluoride—into a single class for regulatory purposes. That's because they share similar properties: All are long-lived and well-mixed in the atmosphere; all trap heat that otherwise would leave the earth and go into outer space; and all are "directly emitted as greenhouse gases" rather than forming later in the atmosphere.

Consequently there is certainly a movement that has a goal of reducing CO2 emissions, and such goals may become regulated requirements in the future. The present solution can assist in achieving these goals, without either endorsing or condemning the underlying "science".

Business Impacts of CO2 System Leaks

A final consideration with the unintended discharge of the gas from the CO2 system is the negative business impact of such a discharge. Obviously the loss of CO2 through a leak is unwanted. More significantly a complete drain of the system will make the system inoperable and can force the establishment to wait until the system is operational to renew normal operations. The operational delay can far exceed the cost of the CO2.

Gas Line Monitoring in Other Fields

It has been known to monitor gas delivery systems in other fields.

U.S. Pat. No. 4,100,537 discloses a system designed to monitor nitrous oxide and oxygen pressure in medical gas piping systems. Summarizing, through the use of pressure sensors in the tank room, the system pressure is monitored. When the system pressure goes below or above the normal pressure range, indicator lights are activated indicating whether the system pressure is too high or too low and whether it is oxygen pressure or nitrous oxide pressure, an audible alarm is sounded to alert the doctor or his personnel that there is a problem with the system pressure.

U.S. Pat. No. 4,270,466 relates to a burner control and uses a gas monitor to shut off a burner at selected readings.

U.S. Published Patent Application 2009-0151652 discloses a gas water heater with a warning function, the gas water heater being disposed in a facility and comprising: a gas water heater main body including a controller having a warning cell; and a gas detecting unit separate from the main body and disposed at an indoor monitoring point of the facility, the gas detecting unit having a gas sensor and being in communication with the controller that can selectively shut off gas supply under appropriate signals.

Korean publication 10-0836072 discloses and illustrates a "Digital Safety Device for a Gas Valve" that is on general interest. Japanese reference 2002-214004 "relates to a flow instrument and an inner tube leak displaying control method provided with the function to report generating of this inner-tube disclosure, when inner-tube disclosure occurs in piping."

There are numerous other gas line monitoring and leak detecting systems and solutions that, like the above systems, are not particularly applicable for efficient use in a beverage dispensing system.

The present invention addresses some of the needs shown in the prior art and provides an efficient and cost effective a gas line leakage and emergency shut-off for a beverage dispensing system preventing unintended environmental discharge of anthropogenic charging gas.

SUMMARY OF THE INVENTION

Some of the advantages of the present invention are achieved with a gas line leakage monitor for beverage dispensing system of the invention which is configured to prevent unintended environmental discharge. The monitor includes a gas inlet configured to be coupled to the source of gas and a gas outlet configured to be coupled to the dispensing portions of the beverage dispensing system. The monitor includes a flow sensor in the monitor configured to detect when gas is flowing through the monitor. The monitor includes a timer coupled to the flow sensor and configured to track the amount of time that the flow sensor detects at least each episode of un-interrupted flow of gas through the monitor. The monitor includes a shut-off valve coupled to the timer and configured to stop the flow of gas through the monitor and to the dispensing portions of the beverage dispensing system when the timer indicates that an episode of un-interrupted flow of gas through the monitor meets a pre-set threshold. The monitor includes a manual reset for the shut-off valve for opening the shut-off valve.

The gas line leakage monitor for beverage dispensing system configured to prevent unintended environmental discharge according to the invention may further include status indicators on the monitor and a flow rate indicator on the monitor. The gas line leakage monitor for beverage dispensing system configured to prevent unintended environmental discharge according the invention may provide that the timer includes a user settable threshold for the pre-set threshold used to trigger the shut-off valve.

Some of the advantages of the present invention are achieved with a method for monitoring gas line leakage monitor in a beverage dispensing system to prevent unintended environmental discharge, the method comprising the steps of: A) detecting when gas is flowing through the system; B) tracking the amount of time for at least each episode of un-interrupted flow of gas detected in step A; C) Stopping the flow of gas through the system when an episode of un-interrupted flow of gas through the system meets or exceeds a pre-set threshold; and D) manually resetting the system to allow further flow of gas through the system for subsequent operation.

The present invention is designed as a gas line leakage monitor for beverage dispensing system but could have application for other gas dispensing systems in which the gas has normal intermittent use.

These and other advantages of the present invention will be clarified in the description of the preferred embodiments taken together with the attached drawings in which like reference numerals represent like elements throughout.

BRIEF DESCRIPTION OF THE DRAWINGS

The invention is illustrated by way of example, and not by way of limitation in the figures of the accompanying drawings in which like reference numerals refer to similar elements.

DESCRIPTION OF THE PREFERRED EMBODIMENTS

Figure 1:
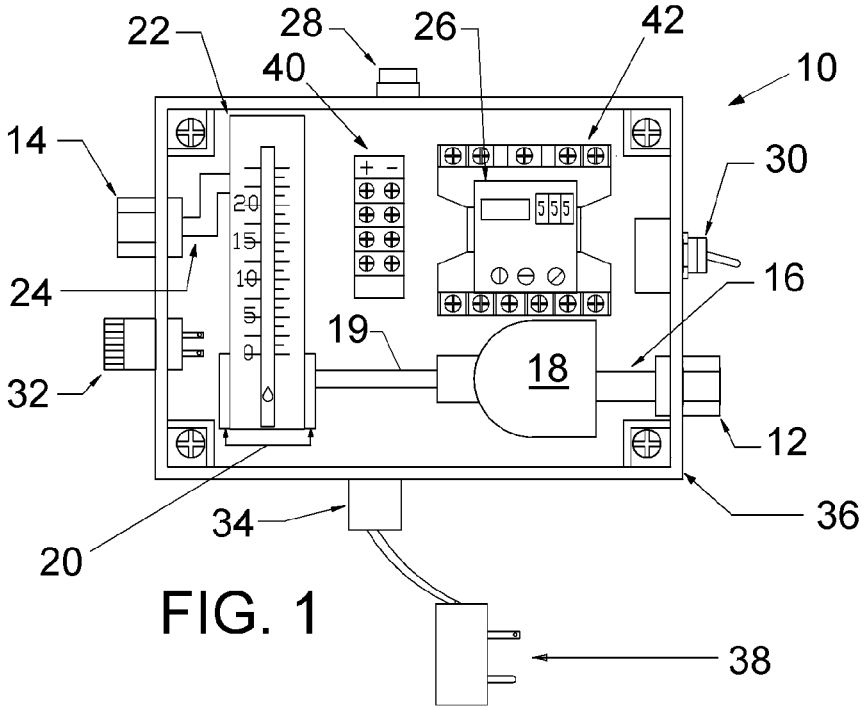
FIG. 1 is a schematic view of a gas line leakage monitor for beverage dispensing system, with a front cover of the monitor removed, which is configured to prevent unintended environmental discharge in according to one aspect of the present invention.
Figure 2:
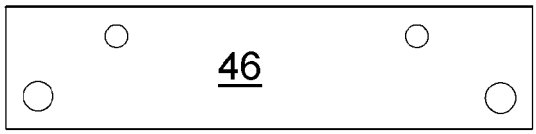
FIG. 2 is a plan schematic view of a wall mount for supporting the monitor of FIG. 1.
Figure 5:
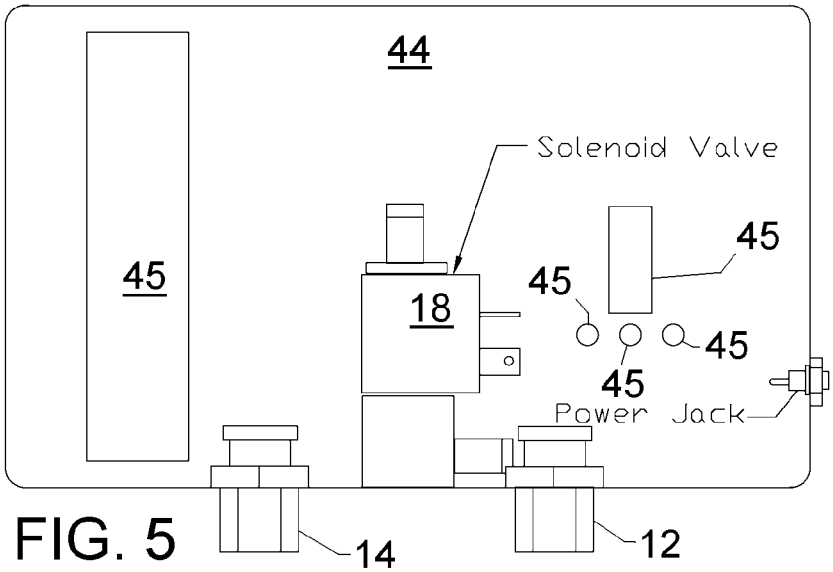
FIG. 5 is a schematic view of the inside cover of the gas line leakage monitor of FIG. 3.
Figure 3:
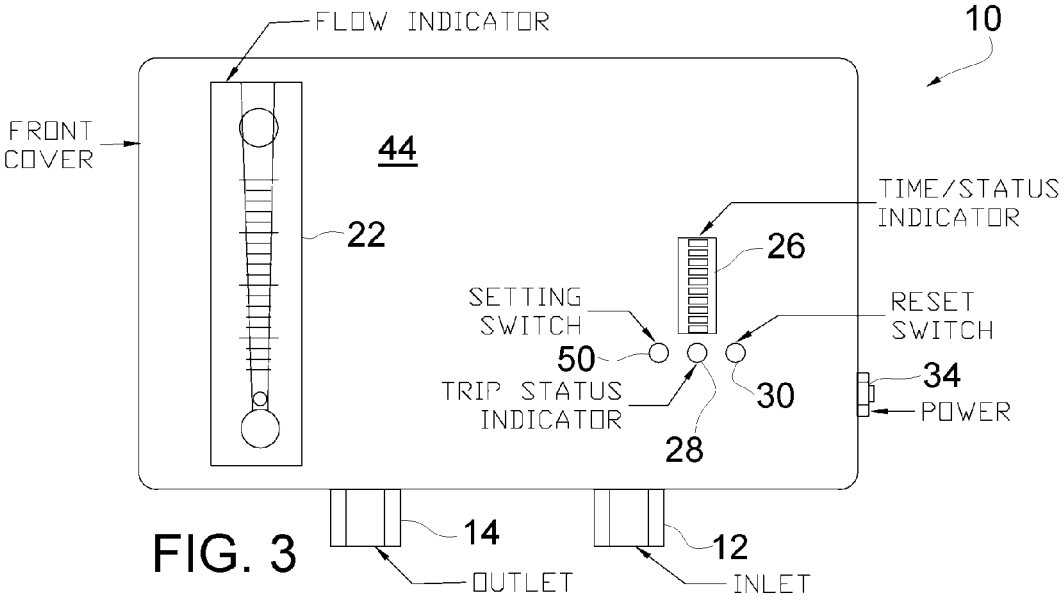
FIG. 3 is a schematic front view of a gas line leakage monitor for beverage dispensing system which is configured to prevent unintended environmental discharge in according to one aspect of the present invention.
Figure 4:
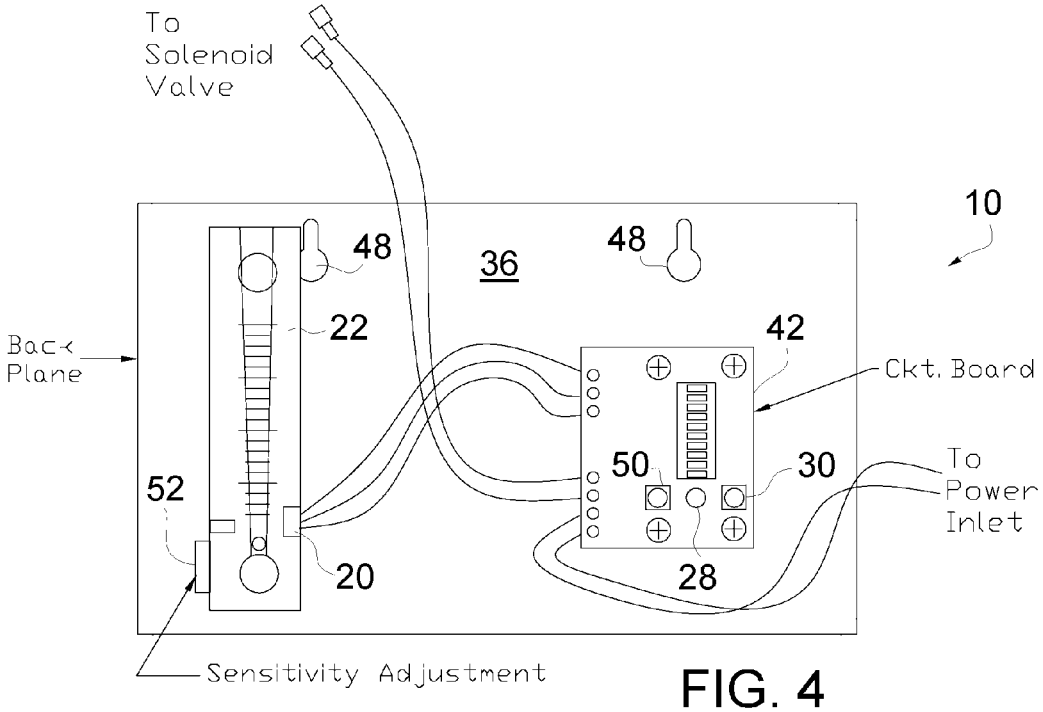
FIG. 4 is a schematic view of the gas line leakage monitor of FIG. 3, with a front cover of the monitor removed and illustrating only selected components of the monitor for clarity.

FIG. 1 is a detailed block diagram of a gas line leakage monitor 10 for beverage dispensing system which is configured to prevent unintended environmental discharge in according to one aspect of the present invention. FIGS. 3-5 illustrate another similar embodiment of the monitor 10.

The monitor 10 includes a gas inlet 12 configured to be coupled to the source of gas, namely a CO2 supply. The inlet 12 is preferably a standard gas line coupling for ease of use. The monitor 10 includes a gas outlet 14 configured to be coupled to the dispensing portions of a beverage dispensing system. Similar to the inlet 12 the outlet 14 is preferably a conventional coupling to ease the in line attachment of the monitor 10 of the present invention.

As described in greater detail below internal monitor flow is as follows, input lines 16 extend from the inlet port 12 to the internal monitor components, namely control or shut-off valve 18, lines 19 extend from the valve 18 to flow sensor 20 and flow indicator 22, with output lines 24 extending from indicator 22 to outlet port 14.

The monitor 10 includes the flow sensor 20 in the monitor 20 configured to detect when gas, namely CO2 or other gas, is flowing through the monitor 10. The flow sensor 20 can be any conventional flow sensor of sufficient sensitivity. The flow sensor 20 as shown is a pair of infra-red sensors across the float ball which is within the flow line of the flow indicator 22. When there is flow though the monitor 10 and sensor 20 the ball of the flow indicator 22 moves along the tube, the infra red sensors note the ball moving out of the beam path and the sensor 20 thus indicates the presence of flow through the monitor. Other conventional flow sensors could be used.

A count-down timer 26 is coupled to the flow sensor 20 and configured to track the amount of time that the flow sensor 20 detects at least each episode of un-interrupted flow of gas through the monitor 10. Specifically, once the flow sensor 20 senses the start of flow a signal is sent to the timer 26 and the timer begins a countdown from the pre-set time period. The timer 26 will continue to countdown while the flow sensor 20 continues to detect the presence of flow through the sensor 22 (i.e. the ball is out of the path of the beam). With the ceasing of flow through the sensor 22 prior to the timer 26 reaching a pre-set threshold, the timer 22 will reset for the next episode of detected flow.

The timer 26 is coupled to the shut-off valve 18. The timer 26 is configured to stop the flow of gas through the monitor 10 and to the dispensing portions of the beverage dispensing system when closed. The valve 18 will close when the timer 26 indicates that an episode of un-interrupted flow of gas through the sensor 20 and monitor 10 meets or exceeds the pre-set threshold. Once the valve 18 is closed an indicator 28, such as an LED, will visually indicate that the monitor 10 has shut off the flow (e.g., go from green to red). The timer 26 can be formed of a number of timing systems and preferably includes a user adjustable input for the threshold. The operation described herein allows for very inexpensive timing circuits to be utilized in the construction of the timer 26.

Once the valve 18 is closed it will remain closed until reset by manual reset 30. Upon resetting the system or monitor 10 with the manual reset 30 the valve 18 will then be in the open position and will close once the timer 26 indicates that a further episode of un-interrupted flow of gas through the sensor 22 and monitor 10 meets or exceeds the pre-set (preferably user adjustable) threshold.

The gas line leakage monitor 10 for beverage dispensing system configured to prevent unintended environmental discharge according to the invention as shown in FIG. 1 and FIGS. 3-5 includes visual status indicators 28 on the monitor 10. The indicators 28 are preferably visible LED lights that indicate the status of the system or monitor 10, such as a green light for normal operation and a red light indicating the valve 18 has been closed and the system 10 needs reset. Other indicating mechanisms can be used including audible alerts, and the like, as known in the art. The indicators 28, assuming they indicate the closure of valve 18 will switch with the operation of the reset 30 and opening of the valve 18.

The gas line leakage monitor for beverage dispensing system configured to prevent unintended environmental discharge according to the figure will include a flow rate indicator 22 on the monitor 10 that is visible to users through an opening 45 in the cover 44. The indicator 22 allows users to gauge the relative flow rate during the operation of the monitor 10.

Another aspect of the monitor 10 of the present invention shown in FIG. 1 includes a fuse 32 for the electrical components of the monitor 10. The fuse 32 is preferably on an easily accessible location on the electrical enclosure 36 housing the monitor 10. A power supply 34 extends from the enclosure 36 and through adaptor 38 allows the monitor 10 to receive power from suitable source through a conventional electrical plug. A 24 volt power supply 40 can receive any conventional power from the power supply 34 and step it down to the voltage for operation of the monitor 10.

The timer 26 is mounted on a base 42 within the enclosure 36. The enclosure 36 includes a cover 44, which is transparent in FIG. 1 and shown FIGS. 3 and 5. The opaque cover 44 with selected openings 45 (or windows) could be replaced with a completely transparent cover. Finally a wall mount 46 and/or mounting openings 48 in the enclosure 36 allows for easy attachment of the enclosure 36 to the wall for easy attachment in-line with the beverage dispensing system.

In operation the monitor 10, when installed inline in a beverage dispensing system, provides a method for monitoring gas line leakage monitor in a beverage dispensing system to prevent unintended environmental discharge and system gas drainage. The method comprises the step of detecting when gas is flowing through the system 10 by the activation of the flow sensor 20. The method comprises the step of tracking on the timer 26 the amount of time for at least each episode of un-interrupted flow of gas detected by the flow sensor 20. The method comprises the step of stopping the flow of gas through the system 10 with the closure of valve 18 when an episode of un-interrupted flow of gas through the system 10 meets or exceeds a pre-set threshold. The method further comprises the step of manually resetting the system 10 with reset 30 to allow further flow of gas through the system for subsequent operation.

The method for monitoring gas line leakage in a beverage dispensing system to prevent unintended environmental discharge according to the invention further comprises the step of installing a gas line monitor 10 and shut-off valve in-line with the beverage dispensing system. The method for monitoring gas line leakage in a beverage dispensing system to prevent unintended environmental discharge according to the invention further comprises the step of setting in-situ the pre-set threshold used to trigger the shut-off valve. A setting control 50 is associated with the timer 26 to allow the user to selectively adjust the pre-set threshold. Additionally adjustable is the sensitivity of the sensor 20 such as raising or lowering the beam so as to be broken by greater or lesser initial flow amounts (greater or smaller movement of the ball or float).

It should be apparent that the pre-set threshold of the timer 26 is selected to be higher than the time of use of any reasonable use of the beverage dispensing system. As a representative example only, it can be selected to be higher than the time it would take to consecutively (with no interruptions) fill 3 pitchers of beverage from the beverage dispenser. Thus if the timer 26 determines continuous flow exceeding the pre-set threshold, it is indicative of a leak or other system failure in the system downstream of the outlet 14, i.e. in the dispensing portions of the beverage dispensing system, and the valve 18 will shut. In this manner the monitor 10 will prevent unintended environmental discharge of anthropogenic carbon dioxide, keeping the workplace safer, minimizing the "carbon footprint" of the system operation, and allow the damaged system to be repaired without the need to re-charge the CO2 tanks.

If there is a power interruption to the system 10, the valve 18 will remain in the position it was in before the power interruption. The only way to move the valve 18 from the closed position to the open position is through activation of the manual reset 30.

The monitor 10 of the present invention can be easily integrated into other devices. For example a CO2 (and/or total air quality sensor) can be added onto the exterior of the enclosure 36 so that technicians and others can be notified if there is an inappropriate buildup of CO2 levels or other air quality issues, even though the present monitor 10 will substantially eliminate the problem of CO2 buildup due to downstream system leaks or other problems.

Further, the timer 26 of the present invention can be coupled to a beverage monitoring system such as described in the beverage automating systems above. Essentially tracking the time of each episode and the duration of each episode measured by the timer 26 on a separate controller will allow the system to track the number of beverages dispensed. Coupling such a controller to the flow indicator 22 will allow the controller to better calculate the estimated flow by knowing the precise flow rate and timing for each episode. The use of these inputs to form a beverage tracking system can be used individually or used in conjunction with beverage monitoring systems already used on the beverage dispensing heads to improve the resulting data. The data may identify problems with distinct dispensing heads in the system or other irregularities.

The present invention is designed as a gas line leakage monitor 10 for beverage dispensing system but could have application for other gas dispensing systems in which the gas has normal intermittent use. For example in gas supply of welding systems, or in gas supply of certain medical applications. Again the monitor 10 is applicable where the conventional use of the gas is intermittent, and for periods substantially less than the entire gas reservoir. In these applications the pre-set threshold of the countdown timer can be set to meaningful amounts for the system.

It will be apparent to those of ordinary skill in the art that various modifications may be made to the present invention without departing from the spirit and scope thereof. The scope of the invention is not to be limited by the illustrative examples described above.

What is claimed is:

1. An inline gas line leakage monitor for gas dispensing system configured to prevent unintended environmental discharge, the monitor comprising:

a gas inlet configured to be coupled to the source of gas;

a gas outlet configured to be coupled to the dispensing portions of the dispensing system;

an in-line flow sensor in the monitor positioned in-line between the gas inlet and the gas outlet and configured to detect when gas is flowing through the monitor from the gas inlet and through the flow sensor and to the gas outlet;

a timer coupled to the flow sensor and configured to track the amount of time that the flow sensor detects at least each episode of un-interrupted flow of gas from the gas inlet through the monitor and through the flow sensor to the gas outlet;

a shut-off valve positioned in-line between the gas inlet and the gas outlet and coupled to the timer and configured to stop the flow of gas through the monitor and to the dispensing portions of the dispensing system when the timer indicates that an episode of un-interrupted flow of gas through the monitor meets or exceeds a pre-set threshold; and a reset for the system including resetting the timer and the shut-off valve by opening the shut-off valve.

2. The gas line leakage monitor for gas dispensing system configured to prevent unintended environmental discharge according claim 1 wherein the gas dispensing system is a beverage dispensing system and wherein the reset is a manual reset and further including visible status indicators on the in-line monitor configured to visibly indicate at least when the shut-off valve has stopped the flow of gas through the in-line monitor and to the dispensing portions of the beverage dispensing system.

3. The gas line leakage monitor for gas dispensing system configured to prevent unintended environmental discharge according claim 1 further including a flow rate indicator on the in-line monitor and wherein the reset is a manual reset.

4. The gas line leakage monitor for gas dispensing system configured to prevent unintended environmental discharge according claim 1 wherein the gas dispensing system is a beverage dispensing system and wherein the timer includes a user settable threshold for the pre-set threshold used to trigger the shut-off valve.

5. The gas line leakage monitor for beverage dispensing system configured to prevent unintended environmental discharge according claim 4 further including visible status indicators on the in-line monitor configured to visibly indicate at least when the shut-off valve has stopped the flow of gas through the in-line monitor and to the dispensing portions of the beverage dispensing system and wherein the reset is a manual reset.

6. The gas line leakage monitor for beverage dispensing system configured to prevent unintended environmental discharge according claim 5 further including a flow rate indicator on the in-line monitor.

7. The gas line leakage monitor for beverage dispensing system configured to prevent unintended environmental discharge according claim 4 further including a flow rate indicator on the in-line monitor.

8. The gas line leakage monitor for beverage dispensing system configured to prevent unintended environmental discharge according claim 4 further including a wall mount for supporting the in-line monitor.

9. A method for monitoring gas line leakage monitor in a beverage dispensing system to prevent unintended environmental discharge, the method comprising the steps of A) detecting when gas is flowing through the system by providing an inline gas line leakage monitor: a gas inlet configured to be coupled to the source of gas, a gas outlet configured to be coupled to the dispensing portions of the dispensing system, an in-line flow sensor in the monitor positioned in-line between the gas inlet and the gas outlet and configured to detect when gas is flowing through the monitor from the gas inlet and through the flow sensor to the gas outlet, a timer coupled to the flow sensor and configured to track the amount of time that the flow sensor detects at least each episode of un-interrupted flow of gas from the gas inlet through the monitor and through the flow sensor to the gas outlet; and a shut-off valve positioned in-line between the gas inlet and the gas outlet and coupled to the timer and configured to stop the flow of gas through the monitor and to the dispensing portions of the dispensing system when the timer indicates that an episode of un-interrupted flow of gas through the monitor meets or exceeds a pre-set threshold, and a reset for the system including resetting the timer and the shut-off valve by opening the shut-off valve;

B) tracking the amount of time for at least each episode of un-interrupted flow of gas detected in step A with the in-line monitor;

C) Stopping the flow of gas through the system through activation of the shutoff when an episode of un-interrupted flow of gas through the system meets or exceeds a pre-set threshold; and D) resetting the system via the system reset to allow further flow of gas through the system for subsequent operation.

10. The method for monitoring gas line leakage in a beverage dispensing system to prevent unintended environmental discharge according to claim 9 further comprising the step of setting in-situ the pre-set threshold used to trigger the shut-off valve.

11. The method for monitoring gas line leakage in a beverage dispensing system to prevent unintended environmental discharge according to claim 9 further comprising the step of visually indicating the status of the monitor.

12. The method for monitoring gas line leakage in a beverage dispensing system to prevent unintended environmental discharge according to claim 11 further comprising the step of visually indicating the flow rate on the monitor.

13. The method for monitoring gas line leakage in a beverage dispensing system to prevent unintended environmental discharge according to claim 9 further comprising the step of visually indicating the flow rate on the monitor.

14. An in-line CO2 line leakage monitor for CO2 dispensing system having normal intermittent use with the monitor configured to prevent unintended environmental discharge of CO2, the monitor comprising:

a CO2 inlet configured to be coupled to the source of CO2;

a CO2 outlet configured to be coupled to the dispensing portions of the CO2 dispensing system;

an in-line flow sensor in the monitor positioned in-line between the CO2 inlet and the CO2 outlet and configured to detect when CO2 is flowing from the CO2 inlet through the monitor and through the flow sensor to the CO2 outlet;

a timer coupled to the in-line flow sensor and configured to track the amount of time that the in-line flow sensor detects at least each episode of un-interrupted flow of CO2 through the monitor;

a shut-off valve coupled to the timer and configured to stop the flow of CO2 from the CO2 inlet through the monitor and through the flow sensor to the CO2 outlet and to the dispensing portions of the CO2 dispensing system when the timer indicates that an episode of un-interrupted flow of CO2 through the monitor meets or exceeds a pre-set threshold; and a manual reset for the system including resetting the timer and the shut-off valve by opening the shut-off valve.

15. The CO2 line leakage monitor for gas dispensing system configured to prevent unintended environmental discharge according claim 14 further including status indicators on the monitor.

16. The CO2 line leakage monitor for gas dispensing system configured to prevent unintended environmental discharge according claim 15 further including a flow rate indicator on the monitor.

17. The CO2 line leakage monitor for gas dispensing system configured to prevent unintended environmental discharge according claim 14 wherein the timer includes a user settable threshold for the pre-set threshold used to trigger the shut-off valve.

18. The CO2 line leakage monitor for gas dispensing system configured to prevent unintended environmental discharge according claim 17 further including status indicators on the monitor.

19. The CO2 line leakage monitor for gas dispensing system configured to prevent unintended environmental discharge according claim 18 further including a flow rate indicator on the monitor.

* * * * *